US006595807B2

(12) United States Patent
Kashiyama

(10) Patent No.: US 6,595,807 B2
(45) Date of Patent: Jul. 22, 2003

(54) STRUCTURE FOR ENGAGING CONNECTOR HOUSING AND REAR HOLDER IN SAME METAL MOLD

(75) Inventor: Motohisa Kashiyama, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/880,911

(22) Filed: Jun. 15, 2001

(65) Prior Publication Data

US 2001/0053638 A1 Dec. 20, 2001

(30) Foreign Application Priority Data

Jun. 16, 2000 (JP) ..... 2000-181399

(51) Int. Cl.[7] ..... H01R 13/436
(52) U.S. Cl. ..... 439/752
(58) Field of Search ..... 439/752, 595

(56) References Cited

U.S. PATENT DOCUMENTS 5,501,619 A 3/1996 Sakatani et al.
5,800,216 A * 9/1998 Okada ..... 439/752
5,980,333 A * 11/1999 Nakamura et al. ..... 439/752

FOREIGN PATENT DOCUMENTS

| | | |
|---|---|---|
| EP | 0 711 005 A2 | 5/1996 |
| EP | 0 733 463 A2 | 9/1996 |
| EP | 0 739 054 A1 | 10/1996 |
| EP | 0 851 535 A2 | 7/1998 |
| JP | 8-336840 | 12/1996 |

OTHER PUBLICATIONS

Patent Abstract of Japan 08–336840, Dec. 24, 1996.

* cited by examiner

*Primary Examiner*—Gary Paumen
(74) *Attorney, Agent, or Firm*—Sughrue Mion, PLLC

(57) ABSTRACT

A structure for engaging a connector housing (2) and rear holders (3, 4), which are molded and engaged with each other in a same metal mold, includes terminal retaining holes (7) communicating with terminal receiving chambers (5) formed in the connector housing (2), guide rails (8) for temporarily retaining the rear holders (3, 4), and projections (9) for completely retaining the rear holders. The rear holders (3, 4) are provided with terminal retaining projections (16) adapted to retain terminals (17), and a pair of wings (13, 13). There are further formed tapered surfaces (11, 12, 15, 18) respectively on the guide rails (8), at a backward end of the connector housing (2) for positioning the rear holders, at distal ends of the pair of the wings (13, 13), and on the terminal retaining projections (16).

12 Claims, 10 Drawing Sheets

STRUCTURE FOR ENGAGING CONNECTOR HOUSING AND REAR HOLDER IN SAME METAL MOLD

BACKGROUND OF THE INVENTION

1. Field of the Invention

The present invention relates to a structure for engaging a connector housing and a rear holder which are molded and engaged with each other in a same metal mold.

The present application is based on Japanese Patent Application No. 2000-181399, which is incorporated herein by reference.

2. Description of the Related Art

Such the connector housing and the rear holders of the type are disclosed in Unexamined Japanese Patent Publication No. Hei. 8-336840 (Japanese Patent Application No. Hei. 7-319334, Title of the Invention: METAL MOLD AND METHOD FOR MANUFACTURING ASSEMBLY OF RESIN MOLDING). A connector housing disclosed in the above mentioned publication has such an outer shape that its backward part beyond a middle part in a longitudinal direction is dimensioned a little smaller than its forward part, and rear holders (corresponding to "retainers" in the above mentioned publication, which are members contributing to retention of terminals which are contained in the connector housing) formed in a substantially U-shape in sectional view are adapted to be engaged with the smaller dimensioned part. Further, the connector housing and the rear holders are constructed in such a manner that the rear holders can be engaged with the connector housing temporarily as well as completely. Processes until the rear holders are temporarily retained with the connector housing are intended to be performed in the same metal mold.

In the above described construction, because the connector housing and the rear holders are simultaneously molded in the same metal mold, and because the connector housing and the rear holders to be molded are different from each other in dimension, there have been such anxieties that molding condition may be limited in scope, and inconveniences such as deformation etc. may occur.

In case where the deformation for example has occurred in the rear holder, there has been a possibility that an end of the rear holder concerned with the engagement may abut against the connector housing, and so, the engagement between the connector housing and the rear holders may be hindered.

When the rear holders are shifted from the temporarily retained state to the completely retained state, there has been a risk that portions of the rear holders contributing to the retention of the terminals cannot be easily inserted into terminal receiving chambers of the connector housing, so that smooth movement of the rear holders cannot be ensured.

SUMMARY OF THE INVENTION

The present invention has been made in view of the above described circumstances, and it is an object of the present invention to provide a structure for engaging a connector housing and a rear holder molded in a same metal mold, enabling the rear holder to be reliably engaged with the connector housing and ensuring smooth movement of the rear holder.

To achieve the above object, according to a first aspect of the present invention, there is provided a structure for engaging a connector housing and a rear holder, which are molded and assembled to engage with each other in a same metal mold. The structure comprises:

- a connector housing including a terminal receiving chamber into which a terminal is insertable, and a terminal retaining hole which communicates with the terminal receiving chamber;
- a rear holder attachable to the connector housing, the rear holder being formed into a substantially U-shape in sectional view so as to be engaged with a slightly smaller dimensioned part of the connector housing;
- a terminal retaining projection, which is formed on the rear holder, and is adapted to enter in the terminal retaining hole to retain the terminal in the terminal receiving chamber;
- a pair of guide rails, which are formed on the connector housing, and by which the rear holder is temporarily retained on the connector housing;
- a pair of projections, which are formed on the connector housing, and by which the rear holder is completely retained on the connector housing;
- a pair of wings, which is formed on the rear holder, and has guide grooves in which the guide rails and the projections are respectively engaged,
- wherein a backward end portion of the connector housing serves as a portion for positioning the rear holder with respect to the connector housing; and
- a plurality of tapered surfaces respectively formed on the guide rails, on the backward end portion, and on distal ends of the wings.

In accordance with the first aspect of the present invention, even though the rear holder is deformed, owing to the tapered surfaces thus formed, the rear holder will not abut against the connector housing to be stopped, but will be guided to a regular position for temporary retainment and complete retainment.

In other words, because the tapered surfaces are formed respectively on the guide rails, on the backward end portion of the connector housing, and on the distal ends of the wings, even though deformation has occurred in the rear holder, the engagement between the connector housing and the rear holder will be reliably performed.

According to a second aspect of the present invention, it is preferable that the terminal retaining projection has a tapered surface formed thereon.

In accordance with the second aspect of the present invention, the tapered surface formed on the terminal retaining projection will allow the terminal retaining projection to easily enter into the terminal receiving chamber. Further, the rear holder will move smoothly.

BRIEF DESCRIPTION OF THE DRAWINGS

The above and other objects and advantages of the present invention will become more apparent by describing in detail a preferred embodiment thereof with reference to the accompanying drawings, wherein.

DETAILED DESCRIPTION OF THE PREFERRED EMBODIMENT

Now, a preferred embodiment of the present invention now will be described with reference to FIGS. 1 to 13.

Figure 1:
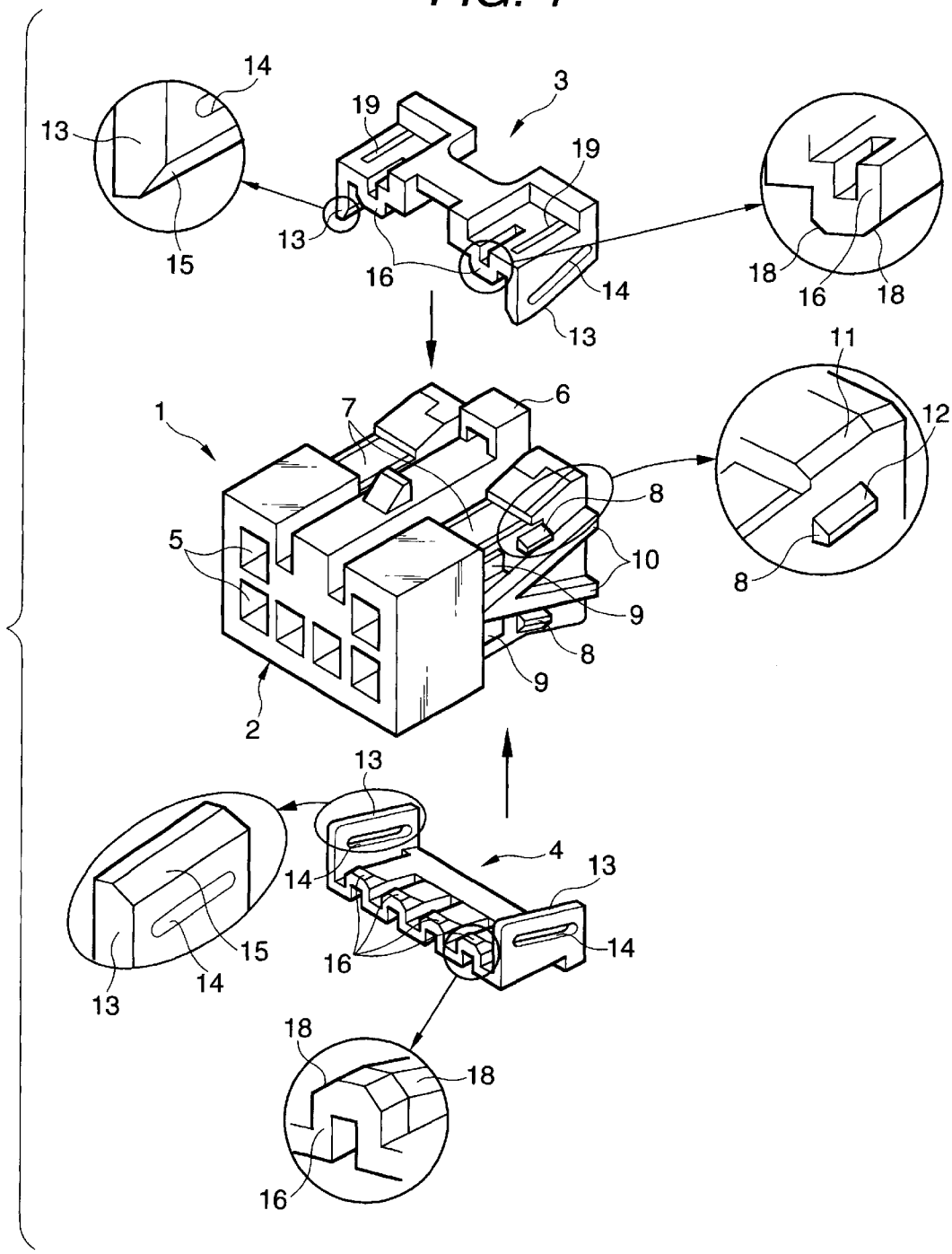
FIG. 1 is an exploded perspective view showing one embodiment of a structure for engaging a connector housing and rear holders in a same metal mold according to the present invention.
Figure 2:
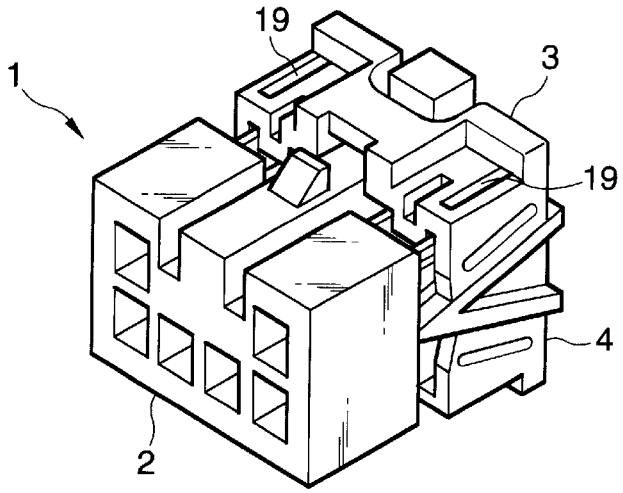
FIG. 2 is a perspective view of a state in which the rear holders are engaged with the connector housing.

In FIG. 1 or FIG. 2, a connector represented by reference numeral 1 includes a connector housing 2 in a rectangular box-like shape, and rear holders 3, 4 in a substantially U-shape in sectional view and adapted to be fitted respectively to an upper surface and a lower surface of the connector housing 2 (The connector housing 2 and the rear holders 3, 4 are products of synthetic resin molded in a same metal mold which will be described below).

The connector housing 2 has terminal receiving chambers 5 in two rows in an upper section and in four rows in a lower section. The terminal receiving chambers 5 in the upper section are formed on both left and right sides of the connector housing 2, and in a center of the connector housing 2, there is formed a lock arm 6 which is flexible in a vertical direction. The connector housing 2 is formed so as to have a slightly smaller outer shape in its backward part beyond a longitudinally middle part of the connector housing 2 than its forward part. With this smaller dimensioned part, the rear holders 3, 4 are adapted to be engaged.

In the above described part having the smaller outer shape (hereinafter referred to as the "smaller dimensioned part"), there are formed terminal retaining holes 7 which open upward and downward respectively. Each of the terminal retaining holes 7 is so formed as to communicate with each of the terminal receiving chambers 5. The smaller dimensioned part has on both side surfaces thereof four guide rails 8 (guide rails for temporary retainment) in a form of a ridge corresponding to the rear holders 3, 4, four small projections 9 (projections for complete retainment), and a pair of left and right protrusions 10. A backward end of the connector housing 2 is provided with tapered surfaces 11 which are inclined toward its side surfaces. The tapered surfaces 11 are formed in order that the engagement of the rear holders 3, 4 can be reliably performed. The backward end portion of the connector housing 2 serves as a portion for positioning the rear holders with respect to the connector housing.

The guide rails 8 are diagonally formed on the aforesaid side surfaces so as to be directed toward a center part in a vertical direction as they extend in a direction toward a forward end of the connector housing 2. The guide rails 8 are respectively provided with tapered surfaces 12 along their longitudinal direction. The tapered surfaces 12 are formed on the sides opposed to the rear holders 3, 4 so that the engagement of the rear holders 3, 4 can be reliably conducted (The temporary engagement of the rear holders 3, 4 can be smoothly performed).

The small projections 9 are formed at forward positions in extended lines of the guide rails 8. The protrusions 10 are formed inside of the guide rails 8 and the small projections 9 diagonally in parallel therewith, and protrude in a V-shape to have a same width as the forward part of the connector housing 2.

The rear holders 3, 4 are formed substantially symmetrically as a whole. The rear holders 3, 4 have a pair of wings 13, 13 respectively and are formed i15 in such a manner that when respective openings (open sides) in a substantially U-shape in sectional view are drawn near to the connector housing 2, the pair of the wings 13, 13 may clamp the smaller dimensioned part of the connector housing 2 from both sides. The wings 13 are diagonally formed so as to go along the protrusions 10. The wings 13 are provided with guide grooves 14 into which the guide rails 8 and the small projections 9 are adapted to enter. The guide grooves 14 are formed so as to correspond to the inclination of the guide rails 8 and the small projections 9. The wings 13, 13 have tapered surfaces 15 at inner surfaces of their distal ends respectively. These tapered surfaces 15 allow the rear holders 3, 4 to be reliably engaged with the connector housing 2, because the tapered surfaces 15 will prevent the wings 13, 13 from striking the connector housing 2 and causing defective engagement.

The rear holders 3, 4 are formed shorter than the smaller dimensioned part of the connector housing 2. Accordingly, when the rear holders 3, 4 are engaged with the connector housing 2 in a clamping manner from the upper and the lower surface sides, the guide rails 8 enter in the guide grooves 14, thereby enabling the rear holders 3, 4 to slide back and forth along the connector housing 2. Meanwhile, the rear holders 3, 4 are drawn near to and apart from the connector housing 2 while moving back and forth, since the wings 13, 13 of the rear holders 3, 4 are formed diagonally. At the forward end in a moving extent of the rear holders 3, 4, the small projections 9 enter into the guide grooves 14.

The rear holders 3, 4 are further provided, at their inner surfaces facing with the connector housing 2, with terminal retaining projections 16 which can be inserted into the terminal retaining holes 7. The rear holder 3 has two terminal retaining projections 16, while the rear holder 4 has four terminal retaining projections 16. The terminal retaining projections 16 function to retain the terminals 17 mounted in the terminal receiving chambers 5 (See FIGS. 3 and 4) to retain them, and are formed in a wedge-like shape projecting outward as they extend in a forward direction. The terminal retaining projections 16 are adapted to enter in the terminal receiving chambers 5 through the terminal retaining holes 7, when the rear holders 3, 4 are respectively drawn near to the connector housing 2. Tapered surfaces 18, 18 are formed on both sides of their distal ends. The tapered surfaces 18, 18 facilitate the terminal retaining projections 16 to enter into the terminal receiving chambers 5, so that the rear holders 3, 4 can make smooth movement. When the terminal 17 (See FIGS. 3 and 4) is on the way of the insertion (incompletely inserted state), the tapered surface 18 abuts against an end surface of the terminal 17 (See FIGS. 3 and 4) so as to guide the terminal 17 to a regular inserting position.

Reference numeral 19 represents cut-outs which are formed at root areas of the wings 13, 13 enabling base end portions of the wings 13, 13 to be flexible.

Figure 3:
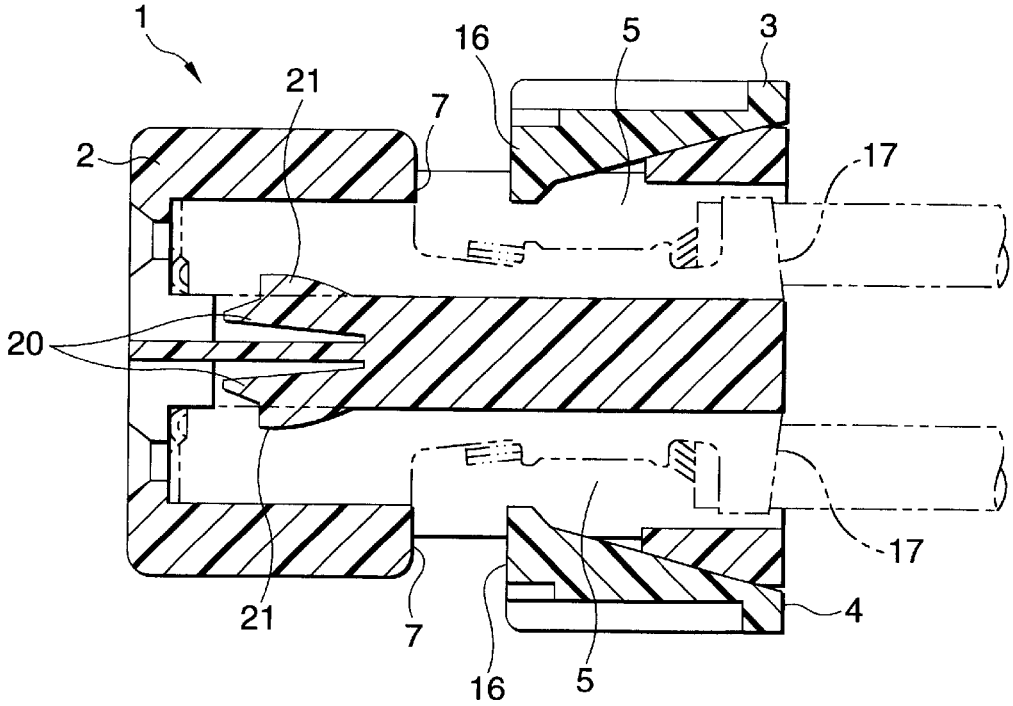
FIG. 3 is a sectional view showing a temporarily retained state of the rear holders.
Figure 4:
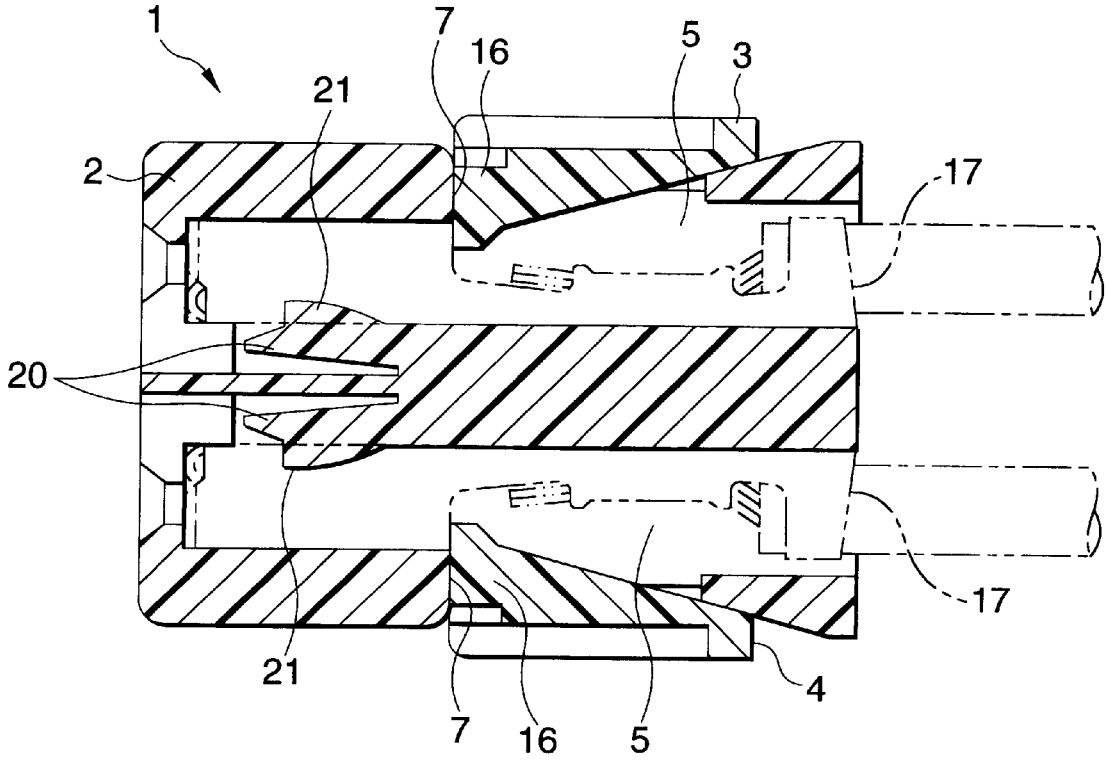
FIG. 4 is a sectional view showing a completely retained state of the rear holders.

Referring now to FIGS. 3 and 4, the terminals 17 in the retained state will be described. It is to be noted that each of the terminal receiving chambers 5 in the connector housing 2 is integrally formed with a flexible lance 20 for retaining the terminal. When the terminal 17 is inserted into the terminal receiving chamber 5, a projection 21 formed on an upper surface of the lance 20 enters in a retaining hole (not shown) formed in a bottom surface of the terminal 17 and retains the terminal 17 (primary retainment). On this occasion, the rear holders 3, 4 are positioned at a backward end of their moving extent. The terminal retaining projections 16 are located at positions where they do not enter in the terminal receiving chambers 5.

Then, as the rear holders 3, 4 are moved toward the forward end of the connector housing 2, the rear holders 3, 4 are drawn near to the connector housing 2 and the terminal retaining projections 16 enter in the terminal receiving chambers 5 through the terminal retaining holes 7. The terminal retaining projections 16 restrict the movement of the terminals 17 in a direction away from the terminal receiving chambers 5. In this manner, the terminals 17 are doubly retained (secondary retainment). Because of the tapered surfaces 18, 18 respectively formed on the terminal retaining projections 16, the rear holders 3, 4 can move smoothly. The state when the rear holders 3, 4 are positioned at the backward end of the connector housing 2 is herein referred to as "the temporarily retained state", and the state when the rear holders 3, 4 are positioned at the forward end of the connector housing is herein referred to as "the completely retained state".

The connector 1 as described herein above is so designed that the connector housing 2 and the rear holders 3, 4 which are component members of the connector are molded in the same metal mold. In addition, the works until the real holders 3, 4 have been brought into the temporarily retained state are intended to be conducted in the above mentioned same metal mold.

Figure 5:
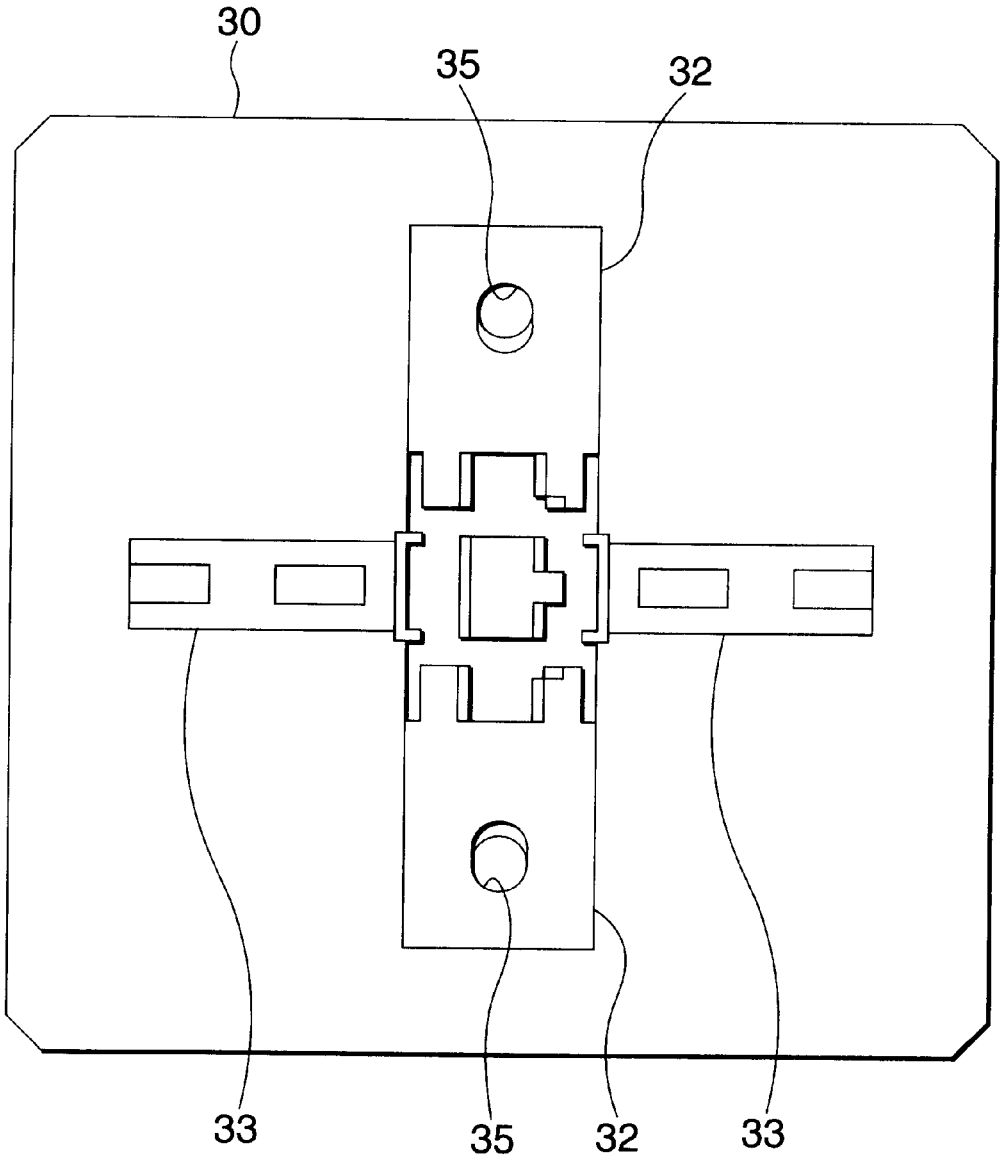
FIG. 5 is a front view of a movable die of the metal mold for molding the connector housing and the rear holders.

FIG. 5 is a front view of a movable die of the metal mold for manufacturing the connector housing 2 and the rear holders 3, 4 of the connector 1. The metal mold includes a set of a movable die 30 which is shown in the drawing and a fixed die 31 to be located toward the front in the drawing.

The movable die 30 includes housing molding dies (slide pins) 32, 32, which are slidable up and down and adapted to mold the connector housing 2 between them at their inner surfaces, and rear holder molding dies 33, 33 (assembly slide pins) which are slidable horizontally to the left and the right of the housing molding dies 32, 32. It is so constructed that a portion of the fixed die 31 is adapted to enter between the rear holder molding dies 33, 33 and side surfaces of the housing molding dies 32, 32, and the rear holders 3, 4 are intended to be molded between the fixed die 31 and the rear holder molding dies 33, 33.

Although in this embodiment, the movable die 30 holds the housing molding dies 32, 32 and the rear holder molding dies 33, 33 which are slide pins, it is apparent that the dies 32, 32, 33, 33 may be held in the fixed die 31.

Figure 6:
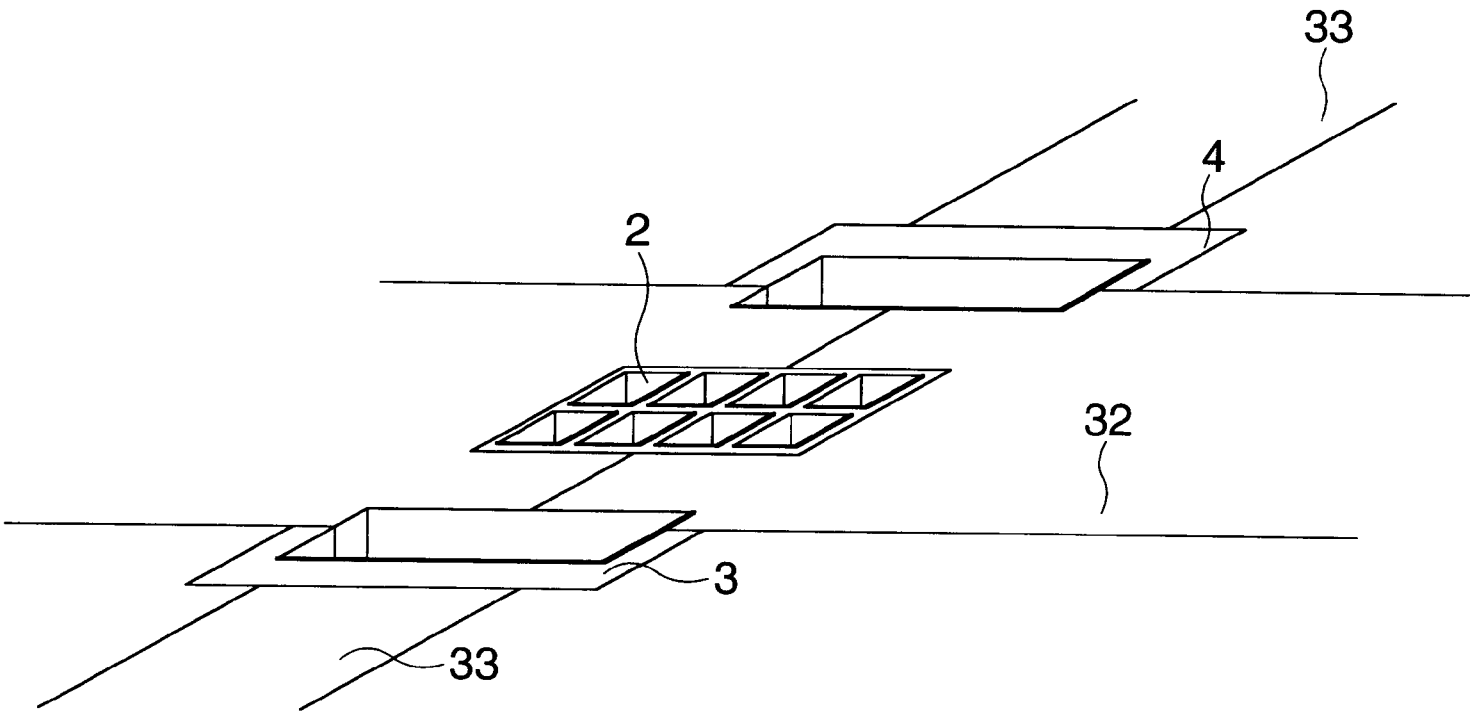
FIG. 6 is a schematic view showing a state of the metal mold when the connector housing and the rear holders are molded.
Figure 7:
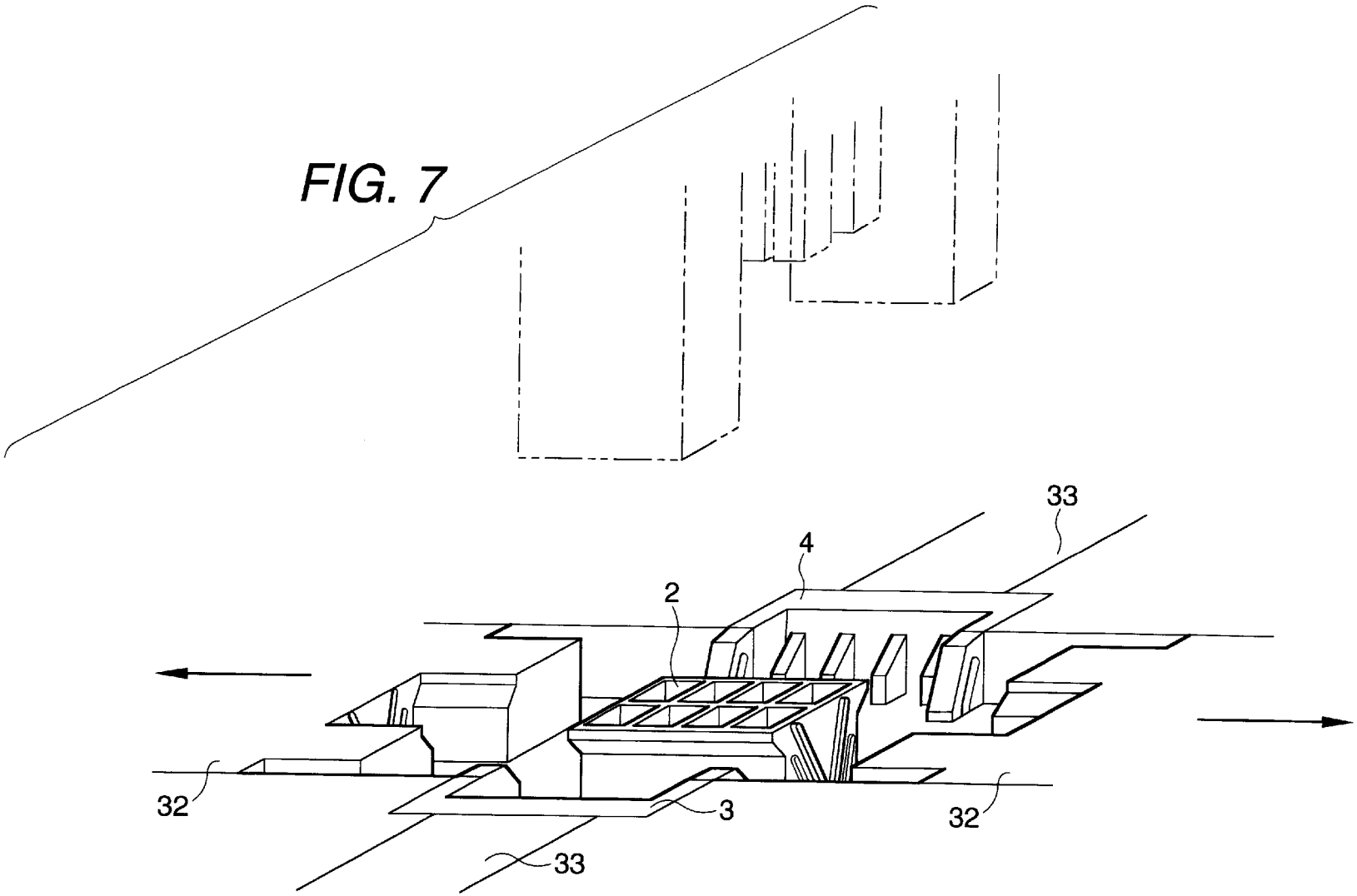
FIG. 7 is a schematic view showing a state where housing molding dies of the movable die are opened.
Figure 8:
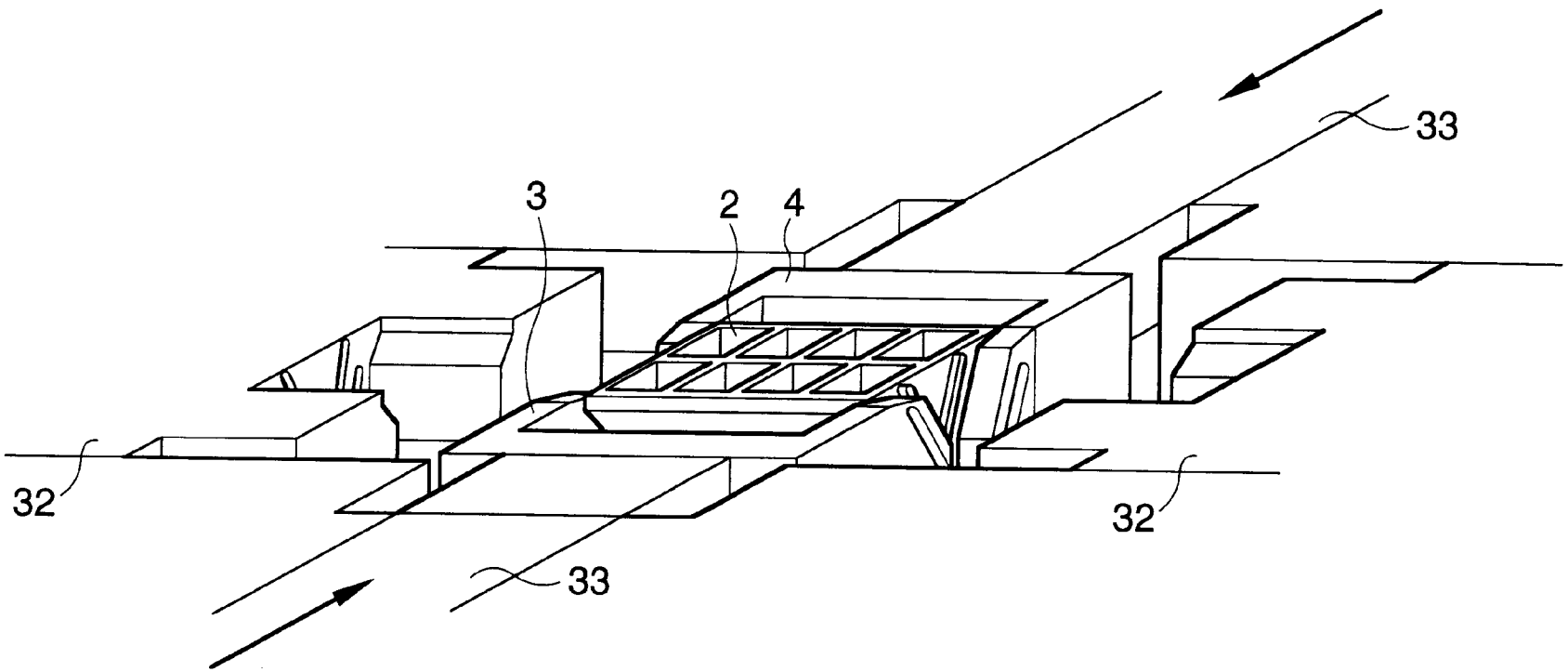
FIG. 8 is a schematic view showing a state where the rear holders are engaged with the connector housing by rear holder molding dies of the movable die.
Figure 9:
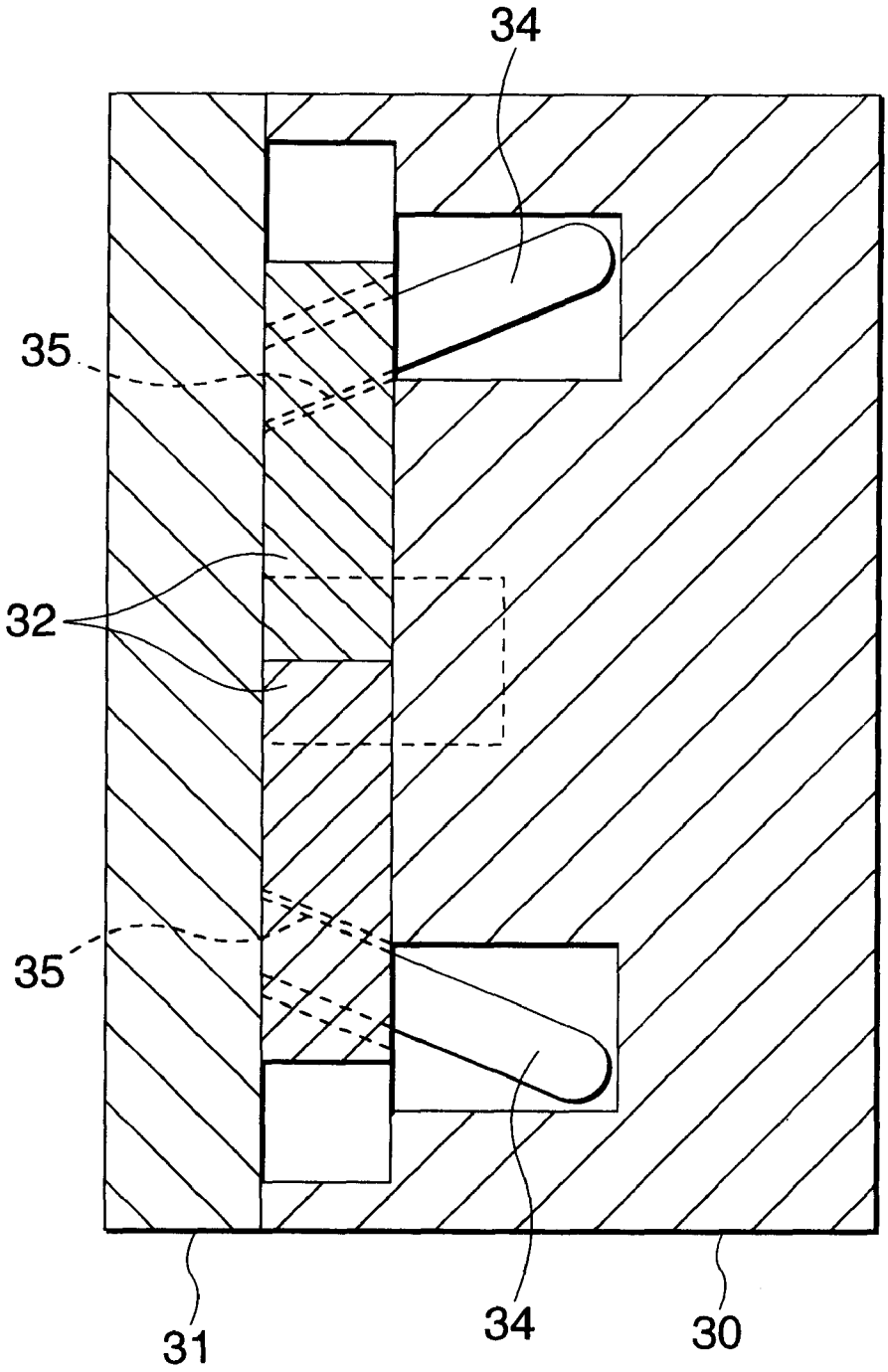
FIG. 9 is a schematic sectional view showing a fixed die and the movable die in a state where the housing molding dies are closed.
Figure 10:
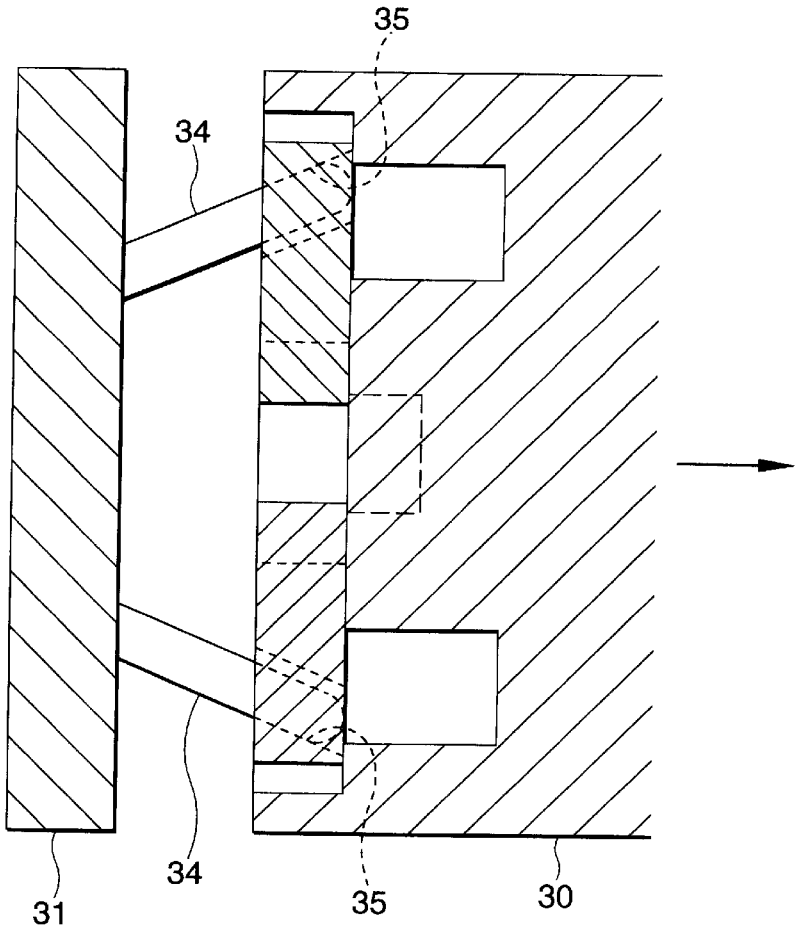
FIG. 10 is a schematic sectional view showing the fixed die and the movable die in a state where the housing molding dies are opened.

FIGS. 6 to 8 are schematic views showing movements of the slide pins in the movable die 30. It is to be noted that the drawings are only diagrammatic sketches but do not correspond to details in particular. These housing molding dies 32, 32 and the rear holder molding dies 33, 33 respectively slide so as to be drawn near to and apart from a core part at a center of the movable die 30. The housing molding dies 32, 32 have diagonal through holes 35, 35 which are adapted to receive angular pins 34, 34 which are formed diagonally projecting from the fixed die 31 toward the movable die 30, as shown in FIGS. 9 and 10. The housing molding dies 32, 32 are adapted to be drawn near to and apart from each other when the fixed die 31 and the movable die 30 are drawn near to and apart from each other on occasion of tightening and opening the metal mold.

Figure 11:
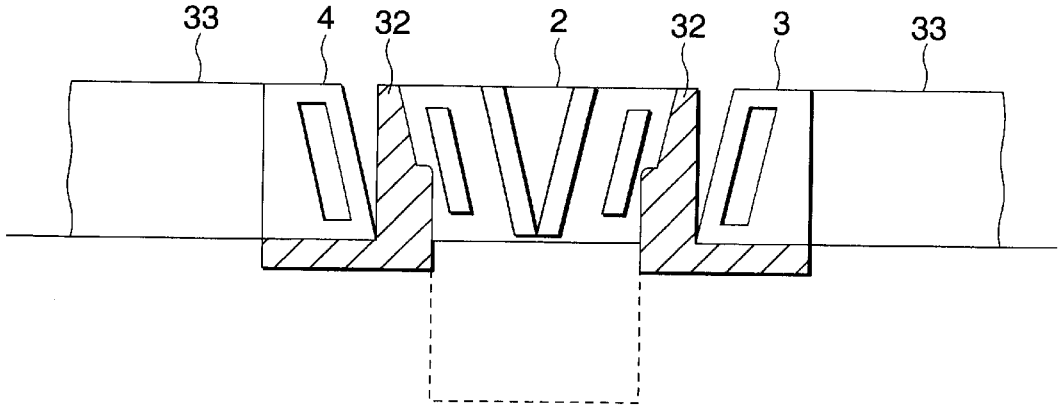
FIG. 11 is a schematic sectional view showing the movable die at a position before movement of the housing molding dies.
Figure 12:
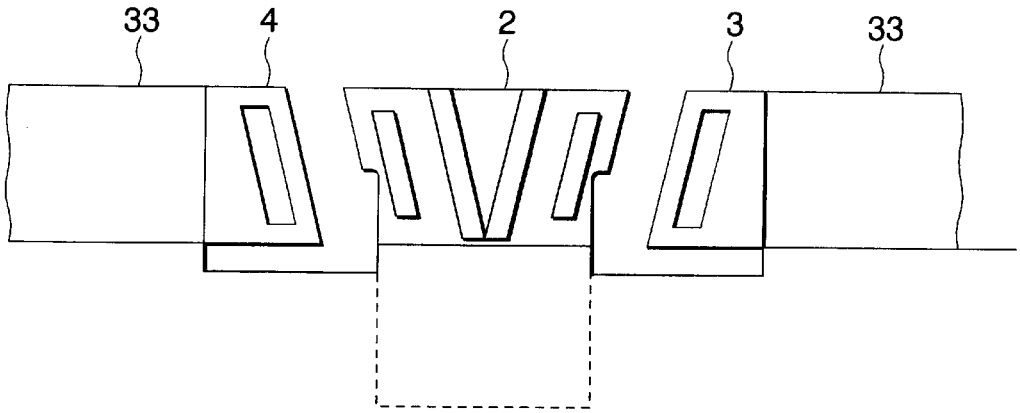
FIG. 12 is a schematic sectional view showing the movable die at a position after the movement of the housing molding dies.

The connector housing 2 is molded between the housing molding dies 32, 32 at their inner surfaces, and as shown in FIG. 11, portions of the housing molding dies 32, 32 are extended as flat plates so as to form backward surfaces of the rear holders 3, 4. Therefore, when both the housing molding dies 32, 32 are kept closed, the rear holders 3, 4 are in contact with the housing molding dies 32, 32 from the backward. However, when the housing molding dies 32, 32 are opened, the rear holders 3, 4 are not in contact with the housing molding dies 32, 32 even at the backward side, as shown in FIG. 12. In other words, the rear holders 3, 4 are brought into a floating condition from the surrounding wall surfaces.

Figure 13:
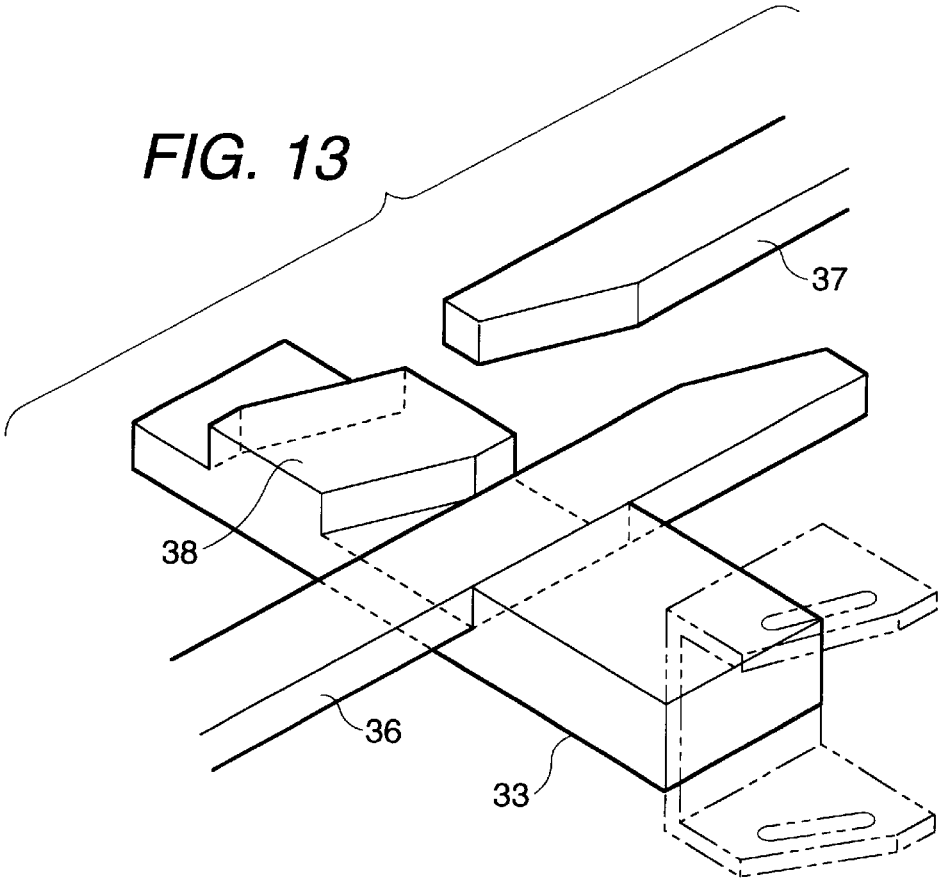
FIG. 13 is a schematic perspective view showing a method of driving the rear holder molding dies.

As shown in FIG. 13, in each of the rear holder molding dies 33, 33, a resetting drive rod 36 which projects from the fixed metal mold 31 and has an inclined surface at its distal end, and an engaging drive rod 37 which projects from an extruding pin (not shown) and has an inclined surface inclined in an opposite direction to the above mentioned resetting drive rod 36 are respectively slidable with respect to a cam portion 38 which is formed at each end of the rear holder molding dies 33, 33 and has inclined surfaces. By pushing out both the drive rods 36, 37 at different timings, the rear holder molding die 33 is driven to reciprocate.

Now, a method of manufacturing the connector 1 having the above described structure by employing the metal mold as constructed as above will be described. At the beginning, the housing molding dies 32, 32 are close to each other in tight contact, and the rear holder molding dies 33, 33 wait at both sides of the housing molding dies 32, 32 at a position where spaces for the rear holders are formed. The fixed die 31 is tightly fitted to a front surface of the movable die 30 in such a manner that it projects into the terminal receiving chambers 5 and between the inner surfaces of the rear holders 3, 4. These projected portions are schematically illustrated by two-dotted chain lines in FIG. 7.

When molten resin is filled in the metal mold, the molten resin will be hardened between the fixed die 31 and the movable die 30 (See FIG. 6). When the fixed die 31 and the movable die 30 are opened after the resin has been hardened, the housing molding dies 32, 32 move apart from each other as shown in FIGS. 7 and 10, as the angular pins 34 are removed from the through holes 35 of the housing molding dies 32, 32. When the housing molding dies 32, 32 have moved apart from each other, the rear holders 3, 4 which have been in contact with the housing molding dies 32, 32 at the backward side will be detached from the housing molding dies 32, 32 and brought in to a floating condition from the wall surface at the backward side, as shown in FIGS. 11 and 12.

On this occasion, the protuberances and hollows formed in the housing molding dies 32, 32 and the rear holder molding dies 33, 33 in a direction perpendicular to a mold opening direction are engaged with these slide pins, and accordingly, the connector housing 2 and the rear holders 3, 4 are retained in the movable die 30 (See FIG. 7).

When the fixed die 31 and the movable die 30 are opened, the housing molding dies 32, 32 are moved apart due to sliding motion of the inclined angular pins 34 with respect to the through holes 35, and the connector housing 2 will be free at its four surfaces, namely upper, lower, left and right surfaces, and at its front surface. When the fixed die 31 is extracted from the movable die 30, the inner surfaces of the rear holder 3 and the rear holder 4 which have been left in the rear holder molding dies 33, 33 are completely exposed, and the rear holders 3, 4 are opposed to each other and held on both sides of the connector housing 2 so as to clamp the connector housing 2.

Thereafter, the extruding pin is actuated, and the inclined surface at the distal end of the engaging drive rod 37 slides along the inclined surface of the cam portion 38 of the rear holder molding die 33 thereby to move the rear holder molding die 33 toward the connector housing 2. In this situation, the rear holders 3, 4 are pressed against the upper surface and the lower surface of the connector housing 2 from their U-shaped openings, while they are retained in the rear holder molding dies 33, 33, as shown in FIG. 8.

The rear holders 3, 4 move in a non-contact manner, floating from the surrounding wall surfaces (See FIG. 12), when they move. Thus, the rear holders 3, 4 are conveyed to the connector housing 2 without generating cutting waste. Since there remains no trash such as cutting waste in the metal mold, molding accuracy of the rear holders 3, 4 which will be molded thereafter will be enhanced.

When the rear holders 3, 4 move, and their left and right wings 13, 13 are drawn near to the connector housing so as to clamp the smaller dimensioned part of the connector housing 2, the distal ends of the wings 13 come into abutment against the backward end of the connector housing 2 and the guide rails 8 in order. Owing to existence of the tapered surfaces 18, the tapered surfaces 11 and the tapered surfaces 12, the wings 13 will easily ride over the backward end of the connector housing 2 and the guide rails 8. Then, when the guide rails 8 are engaged in the guide grooves 14 of the wings 13, the rear holders 3, 4 come into engagement with the connector housing 2 (temporarily retained state). The assembly inside the metal mold will be completed in this manner. The assembly will be completed along with an action of the extruding pin, and by further actuating the extruding pin, the connector housing 2 will be removed from the movable die 30 with the rear holders 3, 4 assembled thereto.

As described, the connector housing and the rear holders 3, 4 are simultaneously molded from resin, by the movable die 30 including the housing molding dies 32, 32 and the rear holder molding dies 33, 33 which are slidable, and the fixed die 31 to be mated with the movable die 30. There are formed the spaces between the connector housing 2 and the rear holders 3, 4 which are assembled to each other when the housing molding dies 32, 32 are opened on occasion of opening the fixed die 31 and the movable die 30. The rear holders 3, 4 are pressed against the connector housing 2 while the rear holders 3, 4 are respectively held by the rear holder molding dies 33, 33 from both the left and the right sides, and thus, the connector housing 2 and the rear holders 3, 4 are assembled. Even though deformation has occurred in the rear holders 3, 4 during molding, the engagement between the connector housing 2 and the rear holders 3, 4 will be reliably performed by the tapered surfaces 11, 12, 18.

Although in this embodiment, the movements of the housing molding dies 32, 32 and the rear holder molding dies 33, 33 are effected by the structure which is mechanically linked to the movement of the fixed die 31 and the movable die 30 and the movement of the extruding pin, hydraulic or pneumatic drive or motor drive can be also employed. Moreover, the spaces between the resin molded articles can be formed not only by the mold opening and the rectilinear movement of the slide pins but also by two dimensional or three dimensional drive. Further, the resin molded articles can be moved by cooperation of a plurality of slide pins.

It is contemplated that numerous modifications may be made to the structure for engaging a connector housing and a rear holder, of the present invention without departing from the spirit and scope of the invention as defined in the following claims.

What is claimed is:

1. A structure for engaging a connector housing and a rear holder, which are molded and assembled to engage wit each other in a same metal mold, the structure comprising:

a connector housing including a terminal receiving chamber into which a terminal is insertable, and a terminal retaining hole which communicates with the terminal receiving chamber;

a rear holder attachable to the connector housing, the rear holder being formed into a substantially U-shape in sectional view so as to be engaged with a slightly smaller dimensioned part of the connector housing;

a terminal retaining project on, which is formed on the rear holder, and is adapted to enter in the terminal retaining hole to ret in the terminal in the terminal receiving chamber;

a pair of guide rails, which re formed on the connector housing, and by which the rear holder is temporarily retained on the connector housing;

a pair of projections, which are formed on the connector housing, and by which the rear holder is completely retained on the connector housing;

a pair of wings, which is formed on the rear holder, and has guide grooves in which the guide rails and the projections are respectively engaged, wherein a backward end portion of the connector housing serves as a portion for positioning the rear holder with respect to the connector housing;

a plurality of tapered surfaces respectively formed on the guide rails, on the backward end portion, and on distal ends of the wings;

wherein the rear holder includes cut-outs formed therein at root areas of the wings for allowing base end portions of the wings to be flexible.

2. The structure of claim 1, wherein the terminal retaining projection has a tapered surface formed thereon.

3. The structure of claim 1, wherein the terminal receiving chamber includes a flexible lance for retaining the terminal.

4. The structure of claim 3, wherein the flexible lance includes a projection formed on an upper surface of the lance, the projection adapted to engage a corresponding retaining hole formed in a surface of the terminal.

5. The structure of claim 1, wherein the connector housing includes a lock arm for engaging a portion of the rear holder.

6. The structure of claim 5, wherein the locking arm is flexible in a vertical direction with respect to the rear holder.

7. A structure for engaging a connector housing and a rear holder, which are molded and assembled to engage with each other in a same metal mold, the structure comprising:

a connector housing including a terminal receiving chamber into which a terminal is insertable, and a terminal retaining hole which communicates with the terminal receiving chamber;

a rear holder attachable to the connector housing, the rear holder being formed into a substantially U-shape in sectional view so as to be engaged with a slightly smaller dimensioned part of the connector housing;

a terminal retaining project on, which is formed on the rear holder, and is adapted to enter in the terminal retaining hole to retain in the terminal in the terminal receiving chamber;

a pair of guide rails, which are formed on the connector housing, and by which the rear holder is temporarily retained on the connector housing;

a pair of projections, which are formed on the connector housing, and by which the rear holder is completely retained on the connector housing;

protrusions, which are formed on the connector housing between the guide rails and the projections, a pair of wings, which is formed on the rear holder, and has guide grooves in which the guide rails and the projections are respectively engaged, wherein distal ends of the wings correspond to the protrusions such that the wings move along the protrusions;

wherein the guide grooves are formed to correspond to an inclination of the guide rails and the projections;

wherein a backward end portion of the connector housing serves as a portion for positioning the rear holder with respect to the connector housing;

a plurality of tapered surfaces respectively formed on the guide rails, on the backward end portion, and on distal ends of the wings;

wherein the rear holder includes cut-outs formed therein and adjacent to proximal ends of the wings for allowing the proximal ends of the wings to be flexible.

8. The structure of claim 7 wherein the protrusions are parallel to the guide rails and the projections.

9. The structure of claim 7, wherein the protrusions are diagonally formed in a V-shape.

10. The structure of claim 7, wherein outer surfaces of the protrusions are flush with both an outermost forward portion of the connector housing and the wings.

11. A structure for engaging a connector housing and a rear holder, which are molded and assembled to engage with each other in a same metal mold, the structure comprising:

a connector housing including a terminal receiving chamber into which a terminal is insertable, and a terminal retaining hole which communicates with the terminal receiving chamber;

a rear holder attachable to the connector housing, the rear holder being formed into a substantially U-shape in sectional view so as to be engaged with a slightly smaller dimensioned part of the connector housing:

a terminal retaining projection, which is formed on the rear holder, and is adapted to enter in the terminal retaining hole to retain the terminal in the terminal receiving chamber;

a pair of guide rails, which are formed on the connector housing, and by which the rear holder is temporarily retained on the connector housing;

a pair of projections, which are formed on the connector housing, and by which the rear holder is completely retained on the connector housing;

a pair of wings, which is formed on the rear holder, and has guide grooves in which the guide rails and the projections are respectively engaged, wherein a backward end portion of the connector housing serves as a portion for positioning the rear holder with respect to the connector housing; and a plurality of tapered surfaces respectively formed on the guide rails, on the backward end portion, and on distal ends of the wings, wherein the rear holder includes cut-outs formed therein and adjacent to proximal ends of the wings for allowing the proximal ends of the wings to be flexible.

12. A structure for engaging a connector housing and a rear holder, which are molded and assembled to engage with each other in a same metal mold, the structure comprising:

a connector housing including a terminal receiving chamber into which a terminal is insertable, and a terminal retaining hole, which communicates with the terminal receiving chamber;

a rear holder attachable to the connector housing, the rear holder being formed into a substantially U-shape in sectional view so as to be engaged with a slightly smaller dimensioned part of the connector housing;

a terminal retaining projection, which is formed on the rear holding, and is adapted to enter in the terminal retaining hole to retain the terminal in the terminal receiving chamber;

a pair of guide rails, which an formed on the connector housing, and by which the rear holder is temporarily retained on the connector housing;

a pair of projections, which are formed on the connector housing, and by which the rear holder is completely retained on the connector housing;

a pair of wings, which is formed on the rear holder, and has guide grooves in which the guide rails and the projections are respectively engaged, wherein a backward end portion of the connector housing serves as a portion for positioning the rear holder with respect to the connector housing; and a plurality of tapered surfaces respectively formed on the guide rails, onto backward end portion, and on distal ends of the wings, the structure further comprising:

protrusions, which are formed on the connector housing between the guide rails and the projections, wherein the protrusions are diagonally formed in a V-shape;

wherein the protrusions correspond to an inclination of the guide rails and the projections;

wherein distal ends of the wings correspond to the protrusions such that the wings move along the protrusions; and wherein outer surfaces of the protrusions are flush with both an outermost forward portion of the connector housing and the wings.

* * * * *